US010391782B2

(12) United States Patent
Hosomi

(10) Patent No.: US 10,391,782 B2
(45) Date of Patent: Aug. 27, 2019

(54) RECORDING APPARATUS

(71) Applicant: SEIKO EPSON CORPORATION, Tokyo (JP)

(72) Inventor: Hiroaki Hosomi, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/771,755

(22) PCT Filed: Oct. 28, 2016

(86) PCT No.: PCT/JP2016/004749
§ 371 (c)(1),
(2) Date: Apr. 27, 2018

(87) PCT Pub. No.: WO2017/073074
PCT Pub. Date: May 4, 2017

(65) Prior Publication Data

US 2018/0345679 A1 Dec. 6, 2018

(30) Foreign Application Priority Data

Oct. 30, 2015 (JP) ..... 2015-213930

(51) Int. Cl.
*B41J 2/185* (2006.01)
*B41J 2/195* (2006.01)
(Continued)

(52) U.S. Cl.
CPC ..... *B41J 2/195* (2013.01); *B41J 2/01* (2013.01); *B41J 2/165* (2013.01); *B41J 2/17* (2013.01);
(Continued)

(58) Field of Classification Search
CPC ..... B41J 2/1721; B41J 2002/1728; B41J 2/1735; B41J 2/18; B41J 2002/1856;
(Continued)

(56) References Cited

U.S. PATENT DOCUMENTS 4,527,170 A * 7/1985 Iwasaki ..... B41J 2/195 347/17
6,273,545 B1 8/2001 Oide
(Continued)

FOREIGN PATENT DOCUMENTS

JP 2003127435 A * 5/2003
JP 2004-174773 A 6/2004
(Continued)

OTHER PUBLICATIONS

Machine translation of JP 2003-127435, published on May 2003. (Year: 2003).*

*Primary Examiner* — Huan H Tran

(57) ABSTRACT

A recording apparatus includes a recording head which ejects different types of ink on a medium, a reuse collection ink tank which collects and stores ink ejected from the recording head for each of ink types, a virgin ink tube which supplies virgin ink to the reuse collection ink tank according to the amount of the ink collected from the recording head to the reuse collection ink tank, a diluted solution tube which supplies a diluted solution to the reuse collection ink tank according to viscosity of the ink of the reuse collection ink tank, and a return tube which supplies the ink stored in the reuse collection ink tank to the recording head.

8 Claims, 8 Drawing Sheets

(51) Int. Cl.

| | |
|---|---|
| ***B41J 2/01*** | (2006.01) |
| ***B41J 2/165*** | (2006.01) |
| ***B41J 2/17*** | (2006.01) |
| ***B41J 2/175*** | (2006.01) |
| ***B41J 2/21*** | (2006.01) |

(52) U.S. Cl.
CPC ..... *B41J 2/175* (2013.01); *B41J 2/185* (2013.01); *B41J 2/21* (2013.01)

(58) Field of Classification Search
CPC ..... B41J 2/195; B41J 2/165; B41J 2/21; B41J 2/185; B41J 2/17; B41J 2/175; B41J 2/01
See application file for complete search history.

(56) References Cited

U.S. PATENT DOCUMENTS

| | | | | |
|---|---|---|---|---|
| 7,293,894 | B2 * | 11/2007 | Shiau ..... | F21L 4/005 362/204 |
| 2008/0284818 | A1 | 11/2008 | Anagnostopoulos | |
| 2015/0077468 | A1 | 3/2015 | Suzuki | |

FOREIGN PATENT DOCUMENTS

| | | | |
|---|---|---|---|
| JP | 2010-167606 | A | 8/2010 |
| JP | 2010-527299 | A | 8/2010 |
| JP | 2010-228300 | A | 10/2010 |
| JP | 2011-079216 | A | 4/2011 |
| JP | 2015-058626 | A | 3/2015 |

* cited by examiner

RECORDING APPARATUS

CROSS-REFERENCE TO RELATED APPLICATIONS

This is a U.S. National Phase application of PCT/JP2016/004749 filed on Oct. 28, 2016, which claims priority to Japanese Patent Application No. 2015-213930, filed on Oct. 30, 2015. The entire disclosure of Japanese Patent Application No. 2015-213930 is hereby incorporated herein by reference.

TECHNICAL FIELD

The present invention relates to a recording apparatus which ejects ink from a recording head to form a pixel on a recording medium.

BACKGROUND ART

In the related art, an ink jet type recording apparatus which ejects ink from a recording head to a recording medium to record an image on the recording medium is known. In this type of the recording apparatus, in order to prevent an increase of viscosity of ink in the recording head, by idly ejecting the ink from a nozzle formed on the recording head, cleaning such as flushing of discharging the ink with increased viscosity from the recording head is executed.

In the recording apparatus in the related art, in order to maintain the nozzle, an operation of cleaning or flushing is performed, therefore ink not used for printing is consumed and the ink becomes waste ink.

If the waste ink is generated, ink consumption is wasted (economic demerit) and waste is increased (environmental demerit).

As a recording apparatus for reducing the waste ink, there is a recording apparatus which includes, for example, a reuse waste ink tank storing the waste ink to form a black pixel on a recording medium by using ejecting ink and the waste ink (for example, see Japanese Unexamined Patent Application Publication No. 2011-079216).

SUMMARY

However, in the related art, since waste ink mixed with a plurality of colors is used for printing, a printable color is only black. In addition, although waste ink obtained by collecting new virgin ink is reused, the waste ink which is used once is not reused and the waste ink is wasted. It is possible to reuse the waste ink once, but it is assumed that ink deterioration becomes severe if the waste ink is used many times.

For this reason, in the related art, there is a problem in that color printing using the waste ink is not possible and the amount of the waste ink cannot be actually zero.

The present invention is provided in view of conditions described above. An object of the present invention is to provide a recording apparatus which significantly reduces the amount of waste ink as compared with the related art in which the color printing is performed using the waste ink.

In order to achieve the object described above, the present invention provides a recording apparatus which ejects different types of ink on a medium, the apparatus including: a recording head; a collected ink storage unit which collects and stores the ink ejected from the recording head for each of the types of the ink; an ink supplement flow path through which virgin ink is supplied to the collected ink storage unit according to the amount of the ink collected from the recording head to the collected ink storage unit; a diluted solution flow path through which a diluted solution is supplied to the collected ink storage unit according to viscosity of the ink of the collected ink storage unit; and an ink supply flow path through which the ink stored in the collected ink storage unit is supplied to the recording head.

According to this configuration, by supplying the virgin ink to the reuse collection ink tank via the ink supplement flow path and supplying the diluted solution to the reuse collection ink tank via the diluted solution flow path, the collected ink with a constant quality can be maintained in the reuse collection ink tank all the time. In addition, since ink for each of ink types is collected, by supplying the ink for each of the ink types from the reuse collection ink tank to the recording head, the collected ink for each of the ink types can be reused and waste ink can be significantly reduced.

In addition, the recording apparatus of the invention further includes: a viscosity measurement unit which measures the viscosity of the ink stored in the collected ink storage unit, in which the diluted solution is supplied to the collected ink storage unit according to the viscosity measured by the viscosity measurement unit.

According to this configuration, by supplying the diluted solution according to the viscosity, the collected ink with a constant quality can be maintained in the collected ink storage unit all the time.

In addition, in the recording apparatus of the invention, each of a plurality of the recording heads which ejects one type of ink includes a plurality of ejecting nozzles, the plurality of the recording heads can be separated from a transport route of the medium, and each of the recording heads separated from the transport route includes an ink collection cap which covers the plurality of the ejecting nozzles.

According to this configuration, the collected ink ejected to the ink collection cap during the flushing is stored in the collected ink storage unit and the collected ink with a constant quality is maintained by the virgin ink and the diluted solution. In addition, by providing the ink collection ink collection cap in the recording head separated from the transport route of the recording medium, it is possible to easily collect the ink ejected by using the flushing.

In addition, in the recording apparatus of the invention, one portion of a transport route of the medium can be evacuated from the plurality of the recording heads 3 including each of the plurality of the ejecting nozzles which ejects one type of ink, and the ink collection cap enters the transport route evacuated from the recording head and covers the plurality of the ejecting nozzles.

According to this configuration, the collected ink ejected to the ink collection cap during the flushing is stored in the collected ink storage unit and the collected ink with a constant quality is maintained by the virgin ink and the diluted solution. In addition, by providing the ink collection cap in the recording head separated from the transport route of the recording medium, it is possible to easily collect the ink ejected by using the flushing.

In addition, in the recording apparatus of the invention, the ink collected in the collected ink storage unit is ink which is flushed and ejected during non-printing operation.

According to this configuration, it is possible to validly collect the ink ejected by using flushing.

In addition, in the recording apparatus of the invention, the ink collected in the collected ink storage unit is ink which is ejected and does not land on the medium during printing operation.

According to this configuration, it is possible to collect the ink which does not land on the recording medium.

In addition, in the recording apparatus of the invention, droplets of the ink collected in the collected ink storage unit enter an ink catcher provided in the recording head by changing a moving direction of the droplets of the ink which moves during the printing operation.

According to this configuration, it is possible to collect the ink which does not land on the recording medium by the ink catcher.

In addition, in the recording apparatus of the invention, a pressure adjustment mechanism in which a pressure inside the collected ink storage unit is set to a negative pressure is provided.

According to this configuration, it is possible to adjust the pressure inside the reuse collection ink tank via the pressure adjustment mechanism.

DESCRIPTION OF EMBODIMENTS

Hereinafter, embodiments of the present invention will be described with reference to drawings.

First Embodiment

Figure 1:
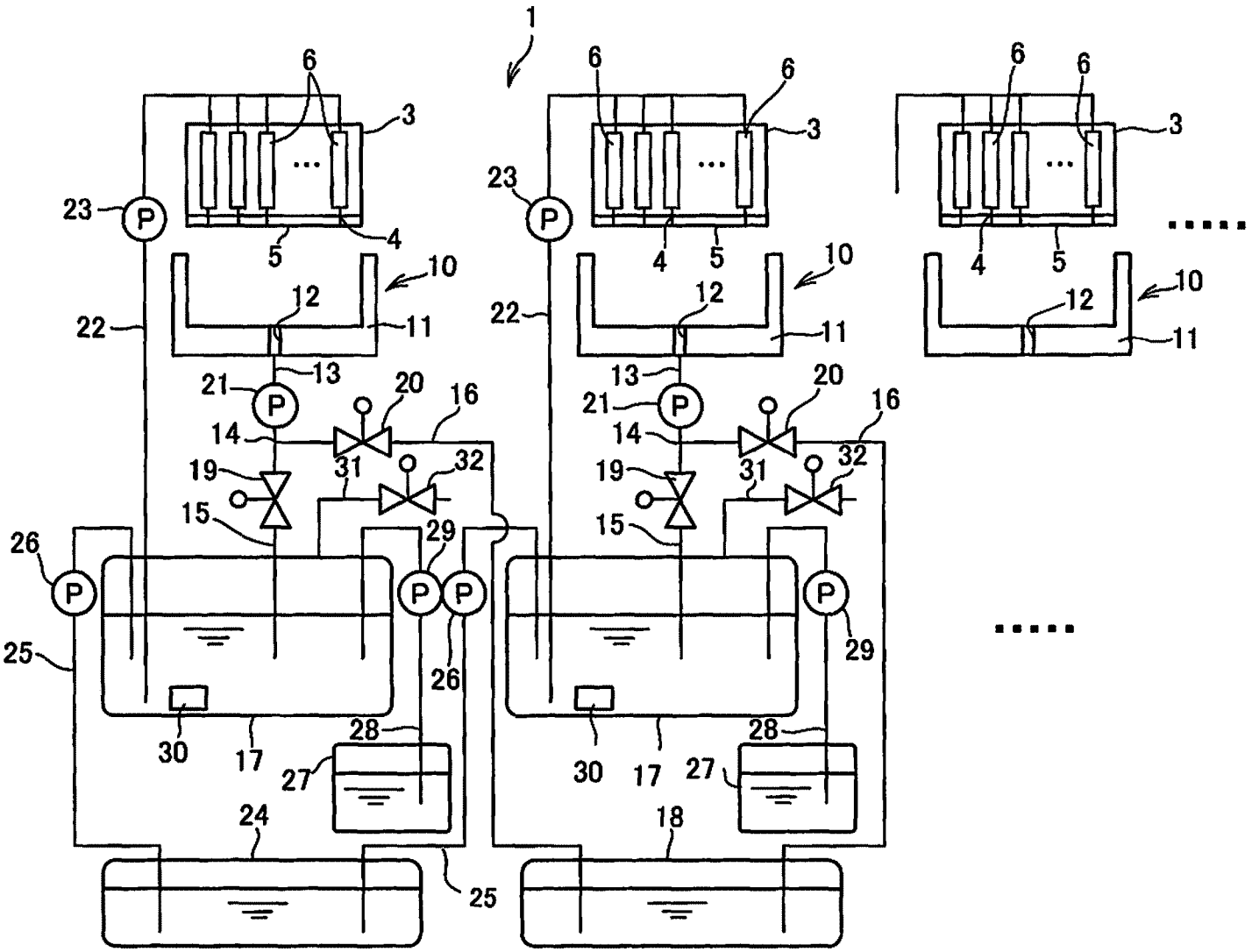
FIG. 1 is a schematic diagram illustrating a configuration of a printer according to a first embodiment.

FIG. 1 is a schematic diagram illustrating a configuration of a first embodiment of a printer as a recording apparatus according to the present invention.

A printer 1 is a printer which records images such as characters, figures, and pictures on a recording medium (not illustrated). In the present embodiment, by forming a dot (pixel) with a predetermined color on a recording medium in a predetermined state according to an image to be recorded on the recording medium, there is provided an ink jet type printer which records the image on the recording medium.

As the recording medium, roll paper wound in a roll shape, a cut sheet cut in a predetermined length, a continuous sheet connected with a plurality of sheets, and the like are used. These recording media are papers such as plain papers, copying papers, thick papers and sheets made of a synthetic resin and those sheets on which a process such as coating and infiltration is executed can also be used. In addition, as a shape of the cut sheet, for example, in addition to cut paper with a regular size such as PPC paper and a postcard, a booklet shape in which a plurality of sheets such as a passbook are bound and a shape formed in a bag shape such as an envelope are used. In addition, as a shape of the continuous sheet, for example, continuous paper in which sprocket holes are drilled at both ends in a width direction and which is folded for each of predetermined lengths can be used.

The printer 1 includes a plurality of recording heads 3 as illustrated in FIG. 1.

In a tip surface of each of the recording heads 3, a plurality of nozzle holes 4 which eject ink as a fine ink drop are opened and in the present embodiment, the recording head 3 is a line head in which a plurality of nozzle holes 4 of ink are arranged in a direction orthogonal to a transport direction of the recording medium. In FIG. 1, only three recording heads 3 is illustrated for convenience and the number of the recording heads 3 is provided as needed according to types of ink.

Each of the recording heads 3 ejects one of types of ink different from one another and one recording head 3 ejects one type of ink. There is provided an ink cartridge 6 which stores ink inside the recording head 3. As the types of ink different from one another, for example, ink of black, cyan, yellow, magenta, white, and the like is used.

The recording head 3 causes an actuator configured using piezoelectric elements to extrude ink supplied from each ink tanks toward the recording medium and to selectively eject a fine ink drop from the nozzle hole 4.

By ejecting ink on the recording medium from the recording head 3 while performing a transport operation of transporting the recording medium in the transport direction by a transport mechanism not illustrated, the printer 1 records the image on the recording medium. During a recording operation, the printer 1 ejects a predetermined amount of ink from each of the nozzle holes 4 of each of the recording heads 3 while transporting the recording medium to form dots constituting the image to be recorded on the recording medium.

In addition, the printer 1 includes a capping device 10. The capping device 10 is provided in each of the recording heads 3.

The capping device 10 includes a box-shaped ink collection cap 11 with an open top and the ink collection cap 11 is configured by an elastic member such as rubber. The ink collection cap 11 is configured to be under driving of a cap driving motor 48 described below and to be ascendable and descendable. When the ink collection cap 11 ascends, the ink collection cap 11 is mounted so as to cover a nozzle forming unit 5 of the recording head 3.

Specifically, an inner circumference of the ink collection cap 11 is approximately the same shape with an outer circumference of the recording head 3. If the ink collection cap 11 ascends to a predetermined position, the nozzle forming unit 5 is stored in a state in which the outer circumference of the recording head 3 is in contact with the inner circumference of the ink collection cap 11.

In addition, in a bottom surface of the ink collection cap 11, a collected ink discharge hole 12 passing through the bottom surface is formed and one tip of a collected ink outflow tube 13 through which collected ink flow is connected to the collected ink discharge hole 12.

The collected ink outflow tube 13 branches to two tubes of a reuse collection ink outflow tube 15 and a waste ink outflow tube 16 in an intersection 14. A reuse collection ink tank 17 (collected ink storage unit) temporally storing reuse collection ink is connected to one side of the reuse collection ink outflow tube 15. A waste ink tank 18 temporally storing waste collection ink is connected to the other side of the waste ink outflow tube 16.

The reuse collection ink tank 17 is provided for each of the recording heads 3, that is, each of ink colors. In the present embodiment, the reuse collection ink tank 17 respectively stores inks with different colors, so that the inks with different colors are not mixed.

In the reuse collection ink outflow tube 15, a reuse side solenoid valve 19 which controls a flow of collected ink through the reuse collection ink outflow tube 15 is provided. In the waste ink outflow tube 16, a waste side solenoid valve 20 which controls a flow of collected ink in the waste ink outflow tube 16 is provided. In the collected ink outflow tube 13 in an upper stream of the intersection 14, a collected ink outflow pump 21 which sucks and ejects collected ink via the collected ink discharge hole 12.

The printer 1 according to the present embodiment executes a flushing operation using the capping device 10.

The flushing operation is an operation of idly ejecting ink from the nozzle hole 4 formed in the nozzle forming unit 5 in a state in which the nozzle forming unit 5 is stored in the ink collection cap 11.

Among a plurality of the nozzle holes 4 formed in the nozzle forming unit 5, in the nozzle hole 4 not used for a recording operation or the nozzle hole 4 with low frequency in use, there is a case where the ink is thickened due to drying or the like to cause poor ejecting. The flushing operation is an operation for preventing the poor ejecting.

In a case of the printer 1 using a line head, a transport route of the recording medium is formed at a position facing the recording head 3, the flushing operation is performed in a state in which the nozzle forming unit 5 of the recording head 3 is exposed by retracting the recording head 3 or retracting the transport route.

During the flushing operation, by the ink collection cap 11 of the capping device 10 ascending to the predetermined position, the nozzle forming unit 5 of the recording head 3 is stored in the ink collection cap 11. Then, a predetermined amount of ink is idly ejected from each of the nozzle holes 4 of each of nozzle rows formed in the nozzle forming unit 5 and remaining ink in each of the nozzle holes 4 is replaced with new ink. The flushing operation is executed, for example, each time a predetermined time elapses.

The ink ejected from the recording head 3 by using the flushing operation is temporally stored in the ink collection cap 11 as collected ink. In the present embodiment, each time the flushing operation is executed, the collected ink outflow pump 21 is driven and the collected ink stored in the ink collection cap 11 is discharged one of the reuse collection ink tank 17 and the waste ink tank 18.

One tip of a return tube 22 (ink supply flow path) is connected to the reuse collection ink tank 17 and the ink cartridge 6 is connected to the other tip of the return tube 22. A return pump 23 which sucks the collected ink from a side of the reuse collection ink tank 17 and ejects the collected ink to a side of the ink cartridge 6 is connected to the return tube 22.

In addition, a remaining collection ink sensor (not illustrated) which measures that the remaining amount of ink is lower than a predetermined threshold value is provided in the ink cartridge 6. In a case where the remaining amount of collected ink in the ink cartridge 6 is lower than the predetermined threshold value, the collected ink stored in the reuse collection ink tank 17 inflows into the ink cartridge 6 via the return tube 22 and is stored in the ink cartridge 6 by the return pump 23.

In addition, the printer 1 according to the present embodiment includes a diluted solution tank 24 which stores a diluted solution. The diluted solution tank 24 and the reuse collection ink tank 17 are connected to with each other via a diluted solution tube 25 (diluted solution flow path). In a middle way portion of the diluted solution tube 25, a diluted solution pump 26 which sucks the diluted solution stored in the diluted solution tank 24 and ejects the diluted solution to the reuse collection ink tank 17 is provided.

In addition, the printer 1 includes a virgin ink tank 27 which stores new ink. The virgin ink tank 27 and the reuse collection ink tank 17 are connected with each other via a virgin ink tube 28 (ink supplement flow path). In a middle way portion of the virgin ink tube 28, a virgin ink supplement pump 29 which sucks virgin ink stored in the virgin ink tank 27 and ejects the virgin ink to the reuse collection ink tank 17 is provided.

The collected ink outflow pump 21, the return pump 23, the diluted solution pump 26, and the virgin ink supplement pump 29 are configured by tube pumps.

Further, in the reuse collection ink tank 17, a viscosity sensor 30 (viscosity measurement unit) which measures viscosity of the collected ink stored in the reuse collection ink tank 17 is provided. In a case where the viscosity sensor 30 measures that the viscosity of the collected ink is more than a predetermined threshold value, the diluted solution pump 26 is driven and the diluted solution is supplied from the diluted solution tank 24 to the reuse collection ink tank 17 to adjust the viscosity of the collected ink.

In addition, a pressure adjustment flow path 31 is connected to the reuse collection ink tank 17 and a pressure adjustment valve 32 is provided in a middle way portion of the pressure adjustment flow path 31. A pressure adjustment mechanism is configured by the pressure adjustment flow path 31 and the pressure adjustment valve 32.

The pressure adjustment valve 32 is opened/closed to adjust a pressure inside the reuse collection ink tank 17 via the pressure adjustment flow path 31. A bubble in the collected collection ink can be removed by setting a pressure in the reuse collection ink tank 17 to a negative pressure.

By settling foreign matter on a bottom of this sub tank, it is possible to prevent the foreign matter from being sent to the recording head 3.

An ink collection mechanism is configured by the capping device 10, each of the ink tanks 17, 27, and 27, each of tubes 13, 15, 16, 22, 25, and 28, each of pumps 21, 23, 26, and 29, each of solenoid valves 19 and 20, and the pressure adjustment flow path 31 and the pressure adjustment valve 32 described above.

In addition, by driving the virgin ink supplement pump 29 according to the amount of the collected ink collected in the reuse collection ink tank 17, virgin ink is supplemented from the virgin ink tank 27 to the reuse collection ink tank 17. According to this, it is possible to secure a quality of the collected ink in the reuse collection ink tank 17 which is equal to or more than a certain level.

Specifically, in a case where the amount of collected ink collected by using the flushing operation is set as X % of the amount of ink consumed by actual printing, if the amount of collected ink:the amount of supplied virgin ink=X:(100−X), it is possible to maintain a constant amount of the collected ink inside the reuse collection ink tank 17.

In addition, in a case where a state in which printing is not performed continues for a long time, a proportion of X becomes high. Then, since a ratio of the virgin ink to the reuse collection ink becomes small, an ink quality may be deteriorated.

For this reason, a ratio of the collected ink to the virgin ink is set to a certain threshold value. For example, the ratio of the collected ink to the virgin ink is set to 20%.

If the ratio of the collected ink is higher than the threshold value of 20%, all of the collected ink is not sent to the reuse collection ink tank 17 and the collected ink may be sent to the waste ink tank 18 closing the reuse side solenoid valve 19 and opening the waste side solenoid valve 20.

According to this configuration, a constant amount of ink with a constant quality is stored inside the reuse collection ink tank 17 all the time.

Although it is possible to grasp the amount of the collected ink by operation time and the amount of operation of the collected ink outflow pump 21, a flowmeter may be provided in the reuse collection ink outflow tube 15. By the flowmeter being provided, it is possible to more accurately grasp the amount of the collected ink, to accurately determine the amount of virgin ink to be supplemented, and it is easy to secure a quality of the collected ink.

Figure 2:
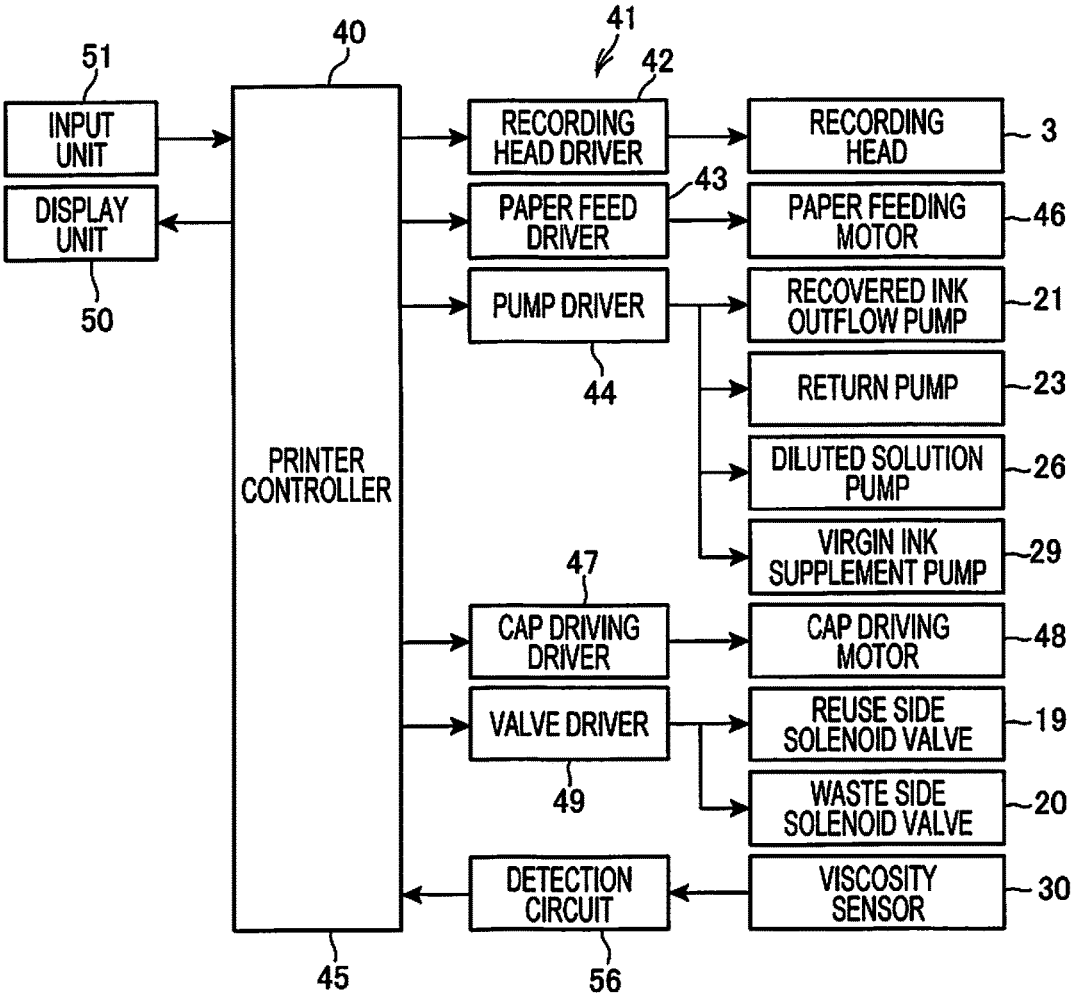
FIG. 2 is a block diagram illustrating a functional configuration of the printer.

FIG. 2 is a block diagram illustrating a functional configuration of the printer 1 according to the first embodiment. As illustrated in FIG. 2, the printer 1 includes a printer controller 40 which controls each of units of the printer 1 and a driver circuit unit 41 which drives each of types of motors according to control of the printer controller 40 and outputs a measurement state of a measurement circuit to the printer controller 40.

The printer controller 40 centrally controls each of the units of the printer 1. The printer controller 40 includes a CPU, a ROM which stores an executable basic control program, data related to the basic control program in a nonvolatile manner, a RAM which temporarily stores a program to be executed by the CPU and predetermined data, another peripheral circuit, and the like.

The driver circuit unit 41 includes a recording head driver 42, a paper feeding driver 43, a pump driver 44, a cap driving driver 47, a valve driver 49, and a measurement circuit 45.

The recording head driver 42 is connected to the recording head 3 provided for each of different colors, drives an actuator included in the recording head 3 according to control of the printer controller 40, and ejects a requirement of ink from the nozzle hole 4 of the nozzle forming unit 5.

The paper feeding driver 43 is connected to a paper feeding motor 46, outputs a driving signal to the paper feeding motor 46, and operates the paper feeding motor 46 by the amount instructed by the printer controller 40. According to operation of the paper feeding motor 46, the recording medium is transported by a predetermined amount in the transport direction.

The pump driver 44 is connected to the collected ink outflow pump 21, the return pump 23, the diluted solution pump 26, and the virgin ink supplement pump 29 respectively provided for each of different colors. According to control of the printer controller 40, the pump driver 44 drives the collected ink outflow pump 21, the return pump 23, the diluted solution pump 26, and the virgin ink supplement pump 29.

The cap driving driver 47 is connected to the cap driving motor 48 provided for each of different colors, drives the cap driving motor 48 according to control of the printer controller 40, and increases or decreases the ink collection cap 11 by a requirement.

The valve driver 49 is connected to the reuse side solenoid valve 19, the waste side solenoid valve 20, and the pressure adjustment valve 32 provided for each of different colors and opens/closes the reuse side solenoid valve 19, the waste side solenoid valve 20, and the pressure adjustment valve 32 according to control of the printer controller 40.

The measurement circuit 45 is connected to the viscosity sensor 30 provided for each of different colors, obtains viscosity of the collected ink in the reuse collection ink tank 17 measured by the viscosity sensor 30, and outputs the viscosity to the printer controller 40.

In addition, a display unit 50 is connected to the printer controller 40 and a light state of a plurality of LEDs included in the display unit 50 can be controlled by the printer controller 40. In addition, an input unit 51 is connected to the printer controller 40 and an operation signal is input from the input unit 51 to the printer controller 40 by operation of an operator for a switch included in the input unit 51.

The printer controller 40 controls each of units of the driver circuit unit 41 based on the operation signal input from the input unit 51 and executes operation for recording the image on the recording medium.

Next, operation of the printer 1 according to the present embodiment will be described.

When a recording start of the image is instructed by a user, by the printer controller 40 obtaining predetermined printing data and controlling the paper feeding driver 43, the printer controller 40 drives the paper feeding motor 46 and transports the recording medium. At the same time, by controlling the recording head driver 42, the actuator of the recording head 3 for each of colors is driven and ink is ejected from each of the nozzle holes 4 to perform desired printing on the recording medium.

Then, when a certain period of time is elapsed, the flushing operation is performed. The flushing operation is performed in a state in which the ink collection cap 11 is mounted on the nozzle forming unit 5 of the recording head 3 by the printer controller 40 controlling the cap driving driver 47 and driving the cap driving motor 48.

In this state, the recording head driver 42 drives the actuator of the recording head 3 and ink is ejected from the nozzle hole 4. The collected ink ejected to the ink collection cap 11 is sent to the reuse collection ink tank 17 by the pump driver 44 driving and controlling the collected ink outflow pump 21.

At this time, by grasping the amount of the collected ink based on operation time and the amount of operation of the collected ink outflow pump 21, the printer controller 40 can grasp the amount of the collected ink inside the reuse collection ink tank 17 and can understand the amount of the virgin ink to be supplemented accordingly.

In a case where the amount of the virgin ink to be supplemented is understood, by controlling the pump driver 44 and driving the virgin ink supplement pump 29, the printer controller 40 supplements virgin ink to the reuse collection ink tank 17 as a requirement.

In addition, the printer controller 40 determines a ratio of the collected ink to the virgin ink. If the ratio of the collected ink is higher than a predetermined threshold value, the printer controller 40 closes the reuse side solenoid valve 19 and opens the waste side solenoid valve 20 to send the collected ink to the waste ink tank 18.

In addition, in a case where the viscosity sensor 30 is determined that the viscosity of the collected ink is higher than a predetermined threshold value, the printer controller 40 drives the diluted solution pump 26 by controlling the pump driver 44 and supplies the diluted solution from the diluted solution tank 24 to the reuse collection ink tank 17.

By control of the printer controller 40, the ratio of the collected ink inside the reuse collection ink tank 17 to the virgin ink is optimal and viscosity is also maintained at optimum high quality.

Then, in a case where the amount of the ink in the ink cartridge 6 is lower than a predetermined threshold value, the printer controller 40 drives a return pump by controlling the pump driver 44 and supplies the ink in the reuse collection ink tank 17 to the ink cartridge 6.

In addition, by opening/closing the pressure adjustment valve 32, the reuse collection ink tank 17 adjusts a pressure inside the reuse collection ink tank 17 via the pressure adjustment flow path 31. A bubble in the collected collection ink can be removed by setting a pressure in the reuse collection ink tank 17 to a negative pressure.

As described above, the printer 1 according to the present embodiment includes the recording head 3, the reuse collection ink tank 17 (collected ink storage unit) which collects and stores ink ejected from the recording head 3 for each of ink types, the virgin ink tube 28 (ink supplement flow path) which supplies virgin ink to the reuse collection ink tank 17 according to the amount of the ink collected from the recording head 3 to the reuse collection ink tank 17, the diluted solution tube 25 (diluted solution flow path) which supplies the diluted solution to the reuse collection ink tank 17 according to viscosity of the ink of the reuse collection ink tank 17, and the return tube 22 (ink supply flow path) which supplies the ink stored in the reuse collection ink tank 17 to the recording head 3.

According to this, by supplying the virgin ink to the reuse collection ink tank 17 via the virgin ink tube 28 and supplying the diluted solution to the reuse collection ink tank 17 via the diluted solution tube 25, the collected ink with a constant quality can be maintained in the reuse collection ink tank 17 all the time. In addition, since ink for each of ink types is collected, by supplying the ink for each of the ink types from the reuse collection ink tank 17 to the recording head 3, the ink for each of the ink types can be reused and waste ink can be significantly reduced.

In addition, the present embodiment further includes the viscosity sensor 30 (viscosity measurement unit) which measures viscosity of the ink stored in the reuse collection ink tank 17 and the diluted solution is supplied to the reuse collection ink tank 17 according to the viscosity measured by the viscosity sensor 30.

According to this, it is possible to maintain constant viscosity of the ink in the reuse collection ink tank 17 all the time.

In addition, in the present embodiment, the ink collected in the reuse collection ink tank 17 is ink which is flushed and ejected during non-printing operation.

According to this, it is possible to validly collect the ink ejected by using flushing. In particular, in a large-sized printer for business, since the amount of ink ejected by using flushing also becomes extremely large, it is possible to reduce waste ink by collecting the ink ejected by using the flushing.

In addition, the present embodiment includes the pressure adjustment flow path 31 and the pressure adjustment valve 32 (pressure adjustment mechanism) which set a pressure inside the reuse collection ink tank 17 to (a negative pressure.

According to this, the pressure adjustment valve 32 is opened/closed to adjust the pressure inside the reuse collection ink tank 17 via the pressure adjustment flow path 31.

Second Embodiment

Next, a second embodiment of the present invention will be described.

In the present embodiment, there is provided a specific example in which an ink collection device is applied to the printer 1.

Figure 3:
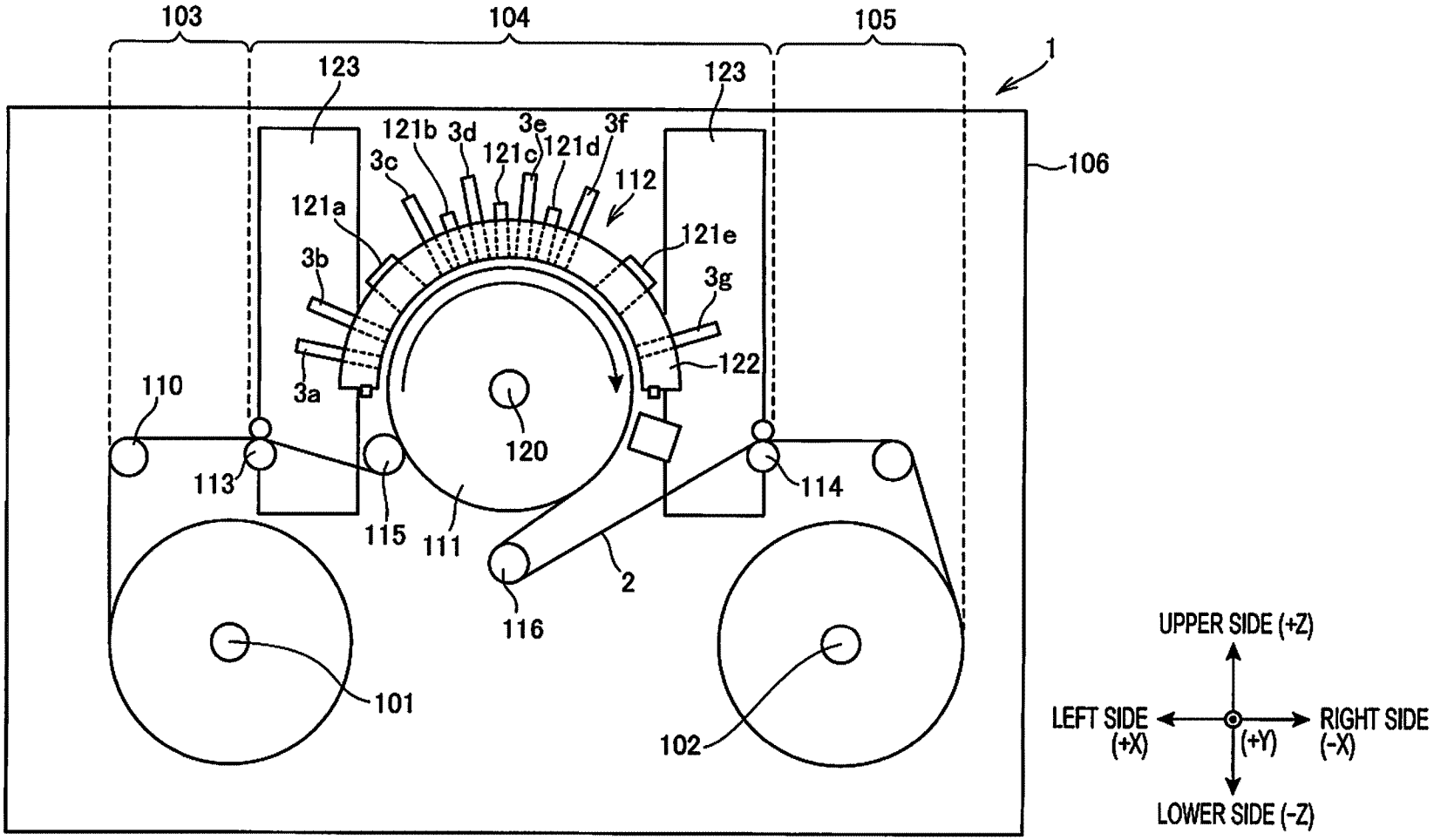
FIG. 3 is a schematic front view illustrating a printer according to a second embodiment.
Figure 4:
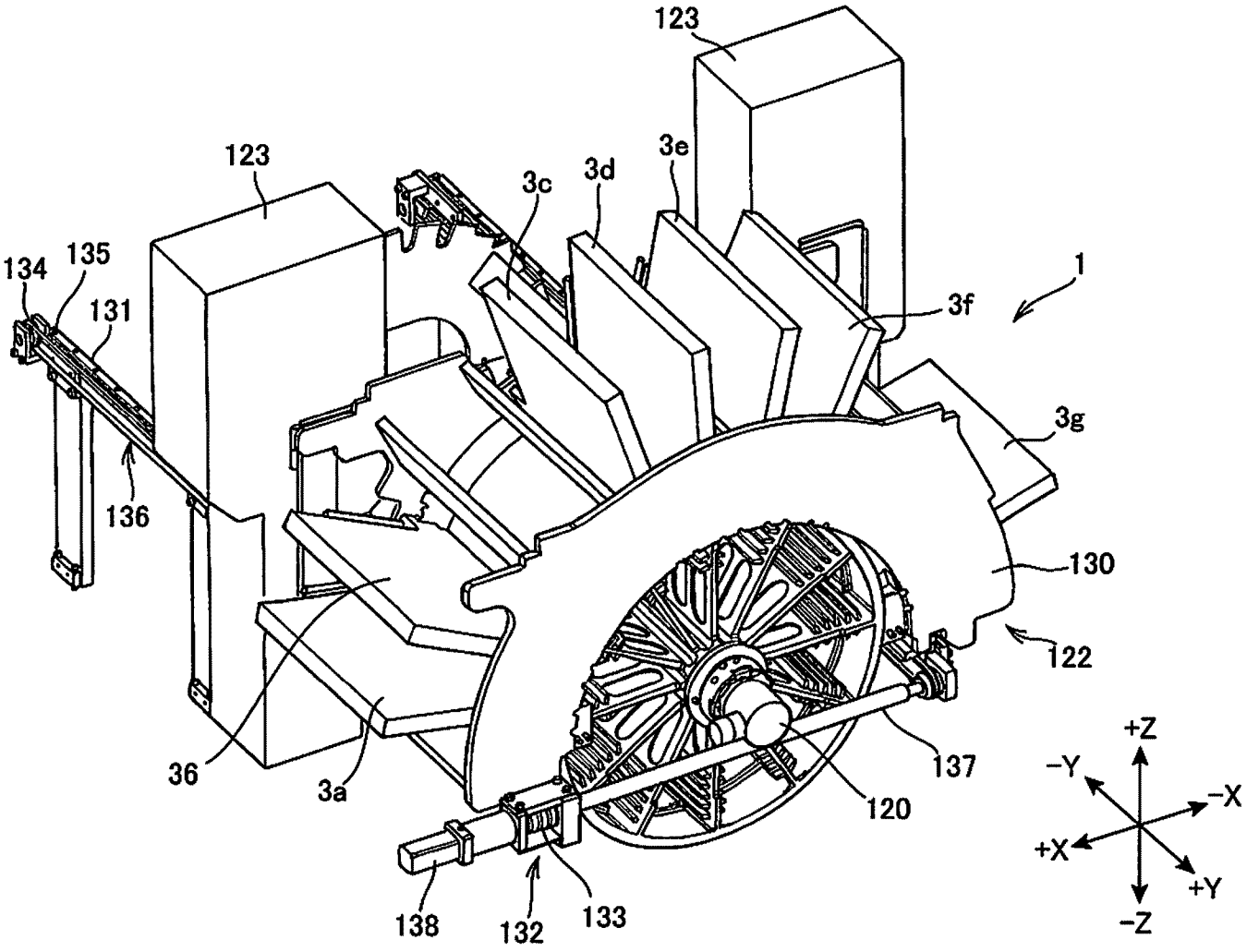
FIG. 4 is a perspective view illustrating a printing region portion of the printer according to the second embodiment.
Figure 5:
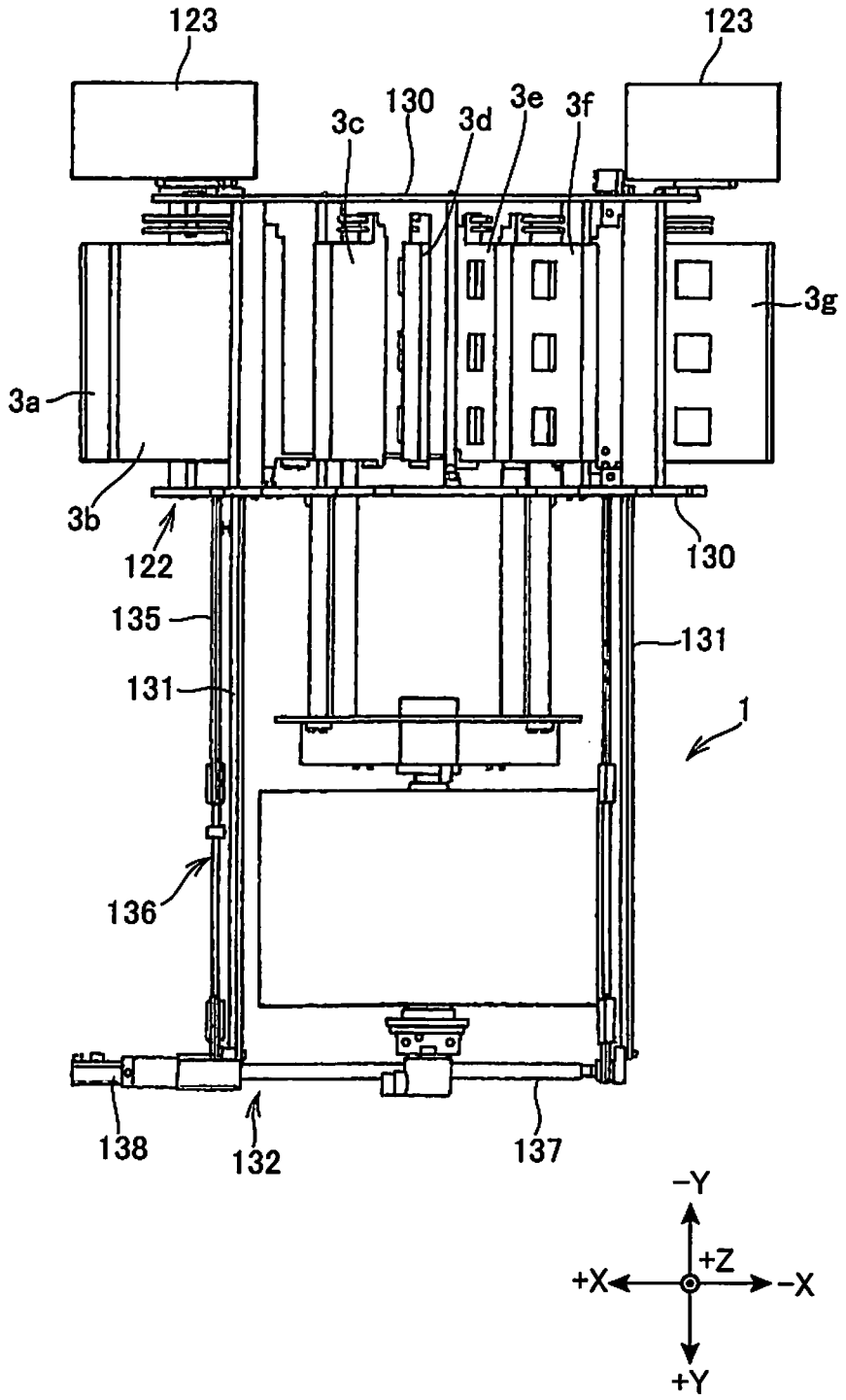
FIG. 5 is a plan view illustrating an evacuation state of a recording head of the printer according to the second embodiment.
Figure 6:
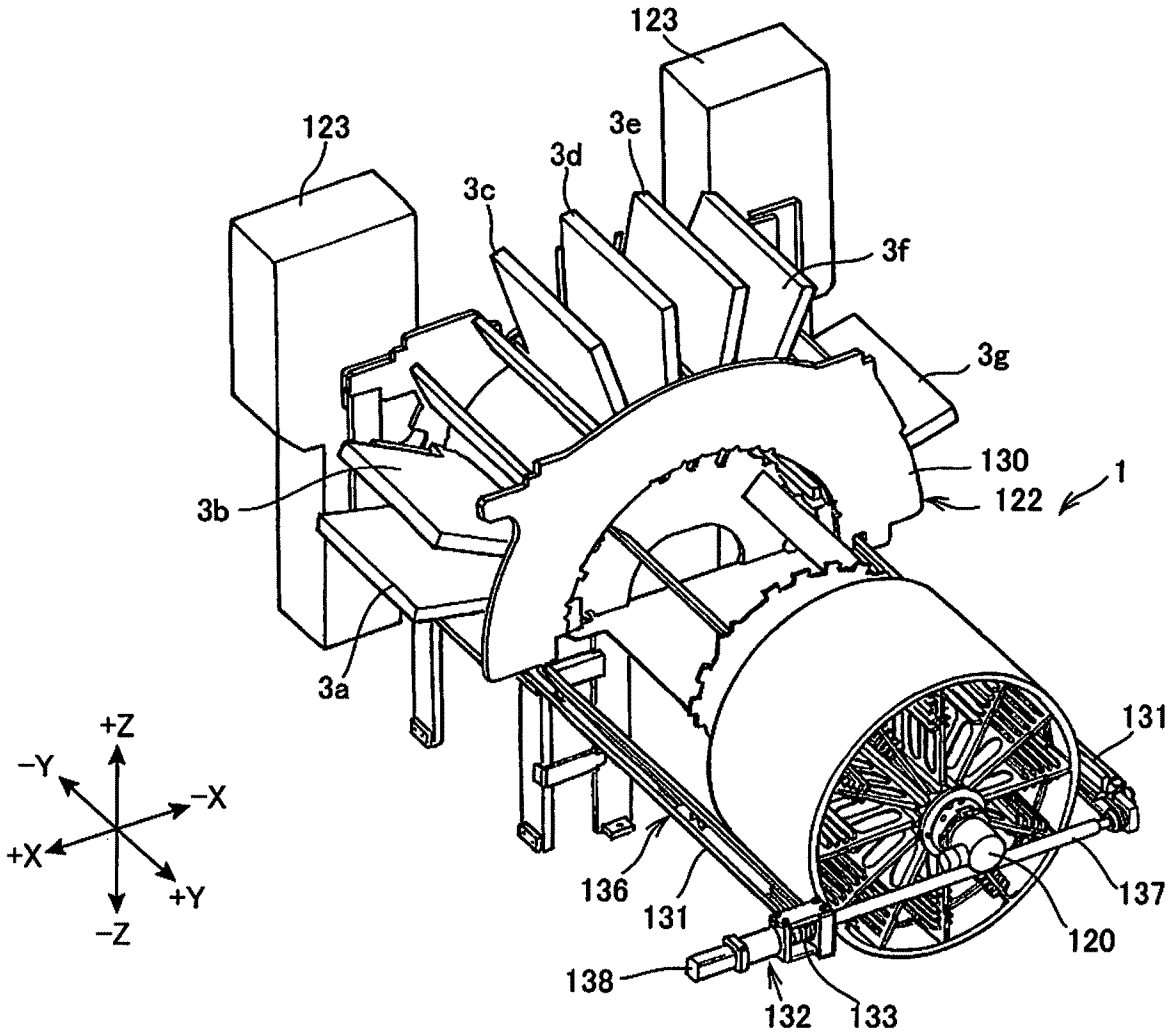
FIG. 6 is a perspective view illustrating the evacuation state of the recording head of the printer according to the second embodiment.

FIG. 3 is a schematic front view illustrating the second embodiment of the printer as the recording apparatus according to the present invention. FIG. 4 is a perspective view illustrating a printing region portion of the printer according to the second embodiment. FIG. 5 is a plan view illustrating an evacuation state of a recording head of the printer according to the second embodiment. FIG. 6 is a perspective view illustrating the evacuation state of the recording head of the printer according to the second embodiment.

In the present embodiment, the same components as those in the embodiment described above are denoted by the same reference numerals and description thereof is omitted.

As illustrated in FIG. 3, in the printer 1, one recording medium 2, in which both ends of the recording medium 2 are wound around a feeding shaft 101 and a winding shaft 102 in a roll shape, in a sheet shape is stretched along the transport route.

The printer 1 includes a feeding unit 103 which feeds the recording medium 2 from the feeding shaft 101, a printing unit 104 which prints the image on the recording medium 2 fed from the feeding unit 103, and a winding unit 105 which winds the recording medium 2 on which the printing unit 104 prints the image around the winding shaft 102. These the feeding unit 103, the printing unit 104, and the winding unit 105 are stored inside a housing 106.

The feeding unit 103 includes the feeding shaft 101 around which the end of the recording medium 2 is wound and a follower roller 110 around which the recording medium 2 fed from the feeding shaft 101 is wrapped.

The recording medium 2 is wound around the feeding shaft 101 to be supported in a state in which a printing surface of the recording medium 2 faces to an outside. Then, in FIG. 3, by clockwise rotating the feeding shaft 101, the recording medium 2 wound around the feeding shaft 101 is fed to the printing unit 104 via the follower roller 110.

While a rotation drum 111 supporting the recording medium 2 fed from the feeding unit 103, the printing unit 104 causes a printing unit 112 disposed along an outer circumferential surface of the rotation drum 111 to print on the recording medium 2. In the printing unit 104, a front driving roller 113 and a rear driving roller 114 are provided on both sides of the rotation drum 111.

In addition, in the printing unit 104, follower rollers 115 and 116 which fold back the recording medium 2 are provided on both sides of a wrapping unit around the rotation drum 111. The follower roller 115 wraps a surface of the recording medium 2 between the front driving roller 113 and the rotation drum 111 and folds back the recording medium 2. On the other hand, the follower roller 116 wraps the surface of the recording medium 2 between the rotation drum 111 and the rear driving roller 114 and folds back the recording medium 2.

According to this, by folding back the recording medium 2 on each of upstream and downstream sides of the rotation drum 111 in the transport direction, it is possible to support the recording medium 2 in a state in which the wrapping unit of the recording medium 2 around the rotation drum 111 is secured at length.

The rotation drum 111 is a drum in a cylindrical shape. The rotation drum 111 includes a rotation shaft 120 extended in an axial direction through a center line of the cylindrical shape. The rotation shaft 120 is rotatably supported by a support mechanism (not illustrated) and the rotation drum 111 rotates around the rotation shaft 120.

In addition, the printing unit 104 includes the printing unit 112 for printing a color image on a surface of the recording medium 2 supported by the rotation drum 111.

The printing unit 112 is configured to include recording heads 3*a* to 3*g*, UV irradiators 121*a* to 121*e*, and an ink supply system 7 supported by a carriage 122.

The seven recording heads 3*a* to 3*g* arranged in order in the transport direction correspond to, for example, white, white, yellow, cyan, magenta, black, and clear (transparent) and ink of the corresponding color in an ink jet method is ejected from the nozzle.

Each of the recording heads 3*a* to 3*g* is a line head in which a plurality of the nozzles extended in a width direction of the recording medium 2 are arranged. Each of the recording heads 3*a* to 3*g* is disposed in a radial shape from the rotation shaft 120 of the rotation drum 111 and is arranged along the outer circumferential surface of the rotation drum 111.

Then, each of the recording heads 3*a* to 3*g* is positioned with respect to the rotation drum 111 by the carriage 122 and faces the rotation drum 111 with a slight gap between each of the recording heads 3*a* to 3*g* and the rotation drum 111. In a state in which a paper gap is defined by the carriage 122 in this manner, by each of the recording heads 3*a* to 3*g* ejecting ink, the ink lands at a desired position on a surface of the recording medium 2 and the color image is formed on the recording medium 2.

As the ink used in the recording heads 3*a* to 3*g*, UV curing ink (light curable ink) which is cured by being irradiated with ultraviolet rays (light) is used. Therefore, in order to cure the ink and fix the ink on the recording medium 2, the UV irradiators 121*a* to 121*e* are provided.

In addition, on a rear side (+Y side) of the carriage 122, two ink supply systems 123 are attached side by side in an X direction.

The ink supply system 123 on a left side (+X side) has a configuration in which a mechanism (ink flow control mechanism) for supplying white, white, yellow, and cyan inks is included for each of colors in a housing 70. The ink supply system 123 on a right side (+X side) has a configuration in which a mechanism (ink flow control mechanism) for supplying magenta, black, and clear inks is included for each of colors in the housing.

As illustrated in FIG. 4, the carriage 122 is configured to include two support frames 130 in an arc shape arranged in a Y direction and a base frame (not illustrated) connected to a lower end of each of the support frames 130. The recording heads 3*a* to 3*g* and the UV irradiators 121*a* to 121*e* are maintained while being sandwiched by the two support frames 130 in the Y direction, and the ink supply system 123 is attached to the support frame 130 on a rear side (−Y side) and is maintained.

In both end portions of the carriage 122 in the X direction, two guide rails 131 extended in the Y direction for supporting the carriage 122 are respectively disposed.

A driving mechanism 132 of the carriage 122 includes a conveyor 136 which is configured by a driving pulley 133, a follower pulley 134, and a belt 135 wrapped around the driving pulley 133 and the follower pulley 134.

The driving pulley 133 and the follower pulley 134 are toothed pulleys formed with a plurality of teeth at a predetermined pitch and the belt 135 is a toothed belt formed with a plurality of teeth at the predetermined pitch.

In a state in which each of the teeth of the driving pulley 133 and the follower pulley 134 and the tooth of the belt 135 are engaged with each other, the belt 135 is wrapped around the driving pulley 133 and the follower pulley 134.

In addition, the driving mechanism 132 includes a link shaft 137 extended in the Y direction. The driving pulley 133 of the conveyor 136 provided in a left end portion and the driving pulley 133 of the conveyor 136 provided in a right end portion are connected with each other by the link shaft 137.

Further, the driving mechanism 132 includes a motor 138 which drives the driving pulley 133 in the left end portion to rotate the driving pulley 133.

By rotating the motor 138, it is possible to synchronously rotate each of the belts 135 wrapped around each of the two driving pulleys 133. When the two belts 135 are synchronously rotated, the carriage 122 receives a driving force transmitted from each of the belts 135 and moves in the Y direction along the guide rails 131 at both of the left and right end portions.

According to this configuration, the carriage 122 is movable in the Y direction on the guide rail 131 with the recording heads 3*a* to 3*g*, the UV irradiators 121*a* to 121*e*, and the ink supply system 123. Then, the printing unit 112 can be alternatively positioned at a printing position, an automatic maintenance position, and a manual maintenance position arranged in the Y direction.

In a case where the carriage 122 is positioned at the printing position, the recording heads 3*a* to 3*g* and the UV irradiators 121*a* to 121*e* maintained in the carriage 122 face to the transport route of the recording medium 2. Therefore, by ejecting ink from the recording heads 3*a* to 3*g* and being irradiated with ultraviolet rays from the UV irradiators 121*a* to 121*e*, it is possible to print the image on the recording medium 2 transported along the transport route.

In addition, in a case where the carriage 122 is positioned at the automatic maintenance position or the manual maintenance position, the recording heads 3*a* to 3*g* and the UV irradiators 121*a* to 121*e* maintained in the carriage 122 are evacuated from the transport route of the recording medium 2 in the Y direction.

Therefore, it is possible to perform desired maintenance while preventing interference in the recording medium 2 along the transport route.

An ink collection cap (not illustrated) constituting a maintenance unit is disposed at a lower portion of the automatic maintenance position. The ink collection cap is provided for each of the recording heads 3*a* to 3*g*.

For the ink collection cap, in a state in which the carriage 122 is positioned at the automatic maintenance position, each of the recording heads 3*a* to 3*g* faces to the ink collection cap from above.

The ink collection cap is provided so as to be able to come into and out contact with the recording head 3 by a driving mechanism (not illustrated).

In a state in which the ink collection cap is mounted on the recording heads 3*a* to 3*g* maintained in the carriage 122 positioned at the maintenance position, the flushing operation is performed.

In a state in which the lower portion of the manual maintenance position is open and the carriage 122 is positioned at the manual maintenance position, a manual space is maintained at a lower portion of the recording heads 3*a* to 3*g* and the UV irradiators 121*a* to 121*e*.

Therefore, an operator can perform maintenance for the recording heads 3*a* to 3*g* and the UV irradiators 121*a* to 121*e* maintained in the carriage 122 positioned at the manual maintenance position by manual operation such as ink wiping.

In the present embodiment, the plurality of the recording heads 3 can be separated from the transport route of the recording medium 2 (medium) and each of the recording heads 3 separated from the transport route includes the ink collection ink collection cap covering the plurality of the ejecting nozzles. That is, in the present embodiment, the carriage 122 moves in a direction orthogonal to the transport route of the recording medium 2 to separate the recording head 3.

In a case where the flushing is performed in a state in which the carriage 122 is maintained at the maintenance position, the ink collection cap is mounted on the recording head 3. At this time, the ink collection cap includes the ink collection mechanism illustrated in FIG. 1.

According to this, the collected ink ejected to the ink collection cap during the flushing is stored in the reuse collection ink tank 17 and the collected ink with a constant quality is maintained by the virgin ink and the diluted solution. In addition, by providing the ink collection ink collection cap in the recording head 3 separated from the transport route of the recording medium 2, it is possible to easily collect the ink ejected by using the flushing.

As described above, in the present embodiment, in the same manner as the first embodiment, by supplying the virgin ink to the reuse collection ink tank 17 and supplying the diluted solution to the reuse collection ink tank 17, the collected ink with a constant quality can be maintained in the reuse collection ink tank 17 all the time. In addition, since ink for each of ink types is collected, by supplying the ink for each of the ink types from the reuse collection ink tank 17 to the recording head 3, the ink for each of the ink types can be reused and waste ink can be significantly reduced.

Third Embodiment

Next, a third embodiment of the present invention will be described.

Figure 7:
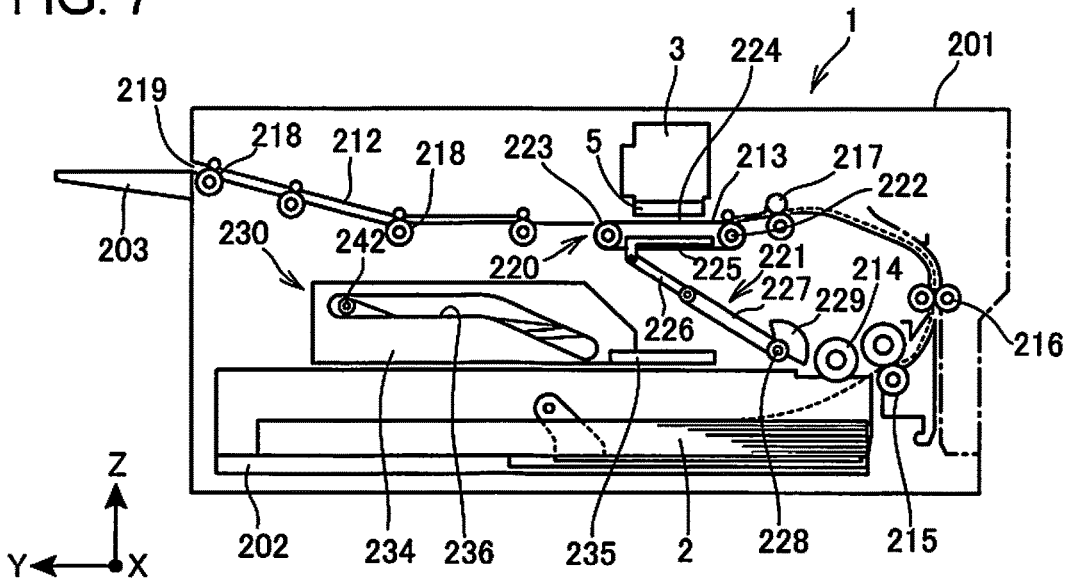
FIG. 7 is a side view illustrating a printing state of a printer according to a third embodiment.
Figure 8:
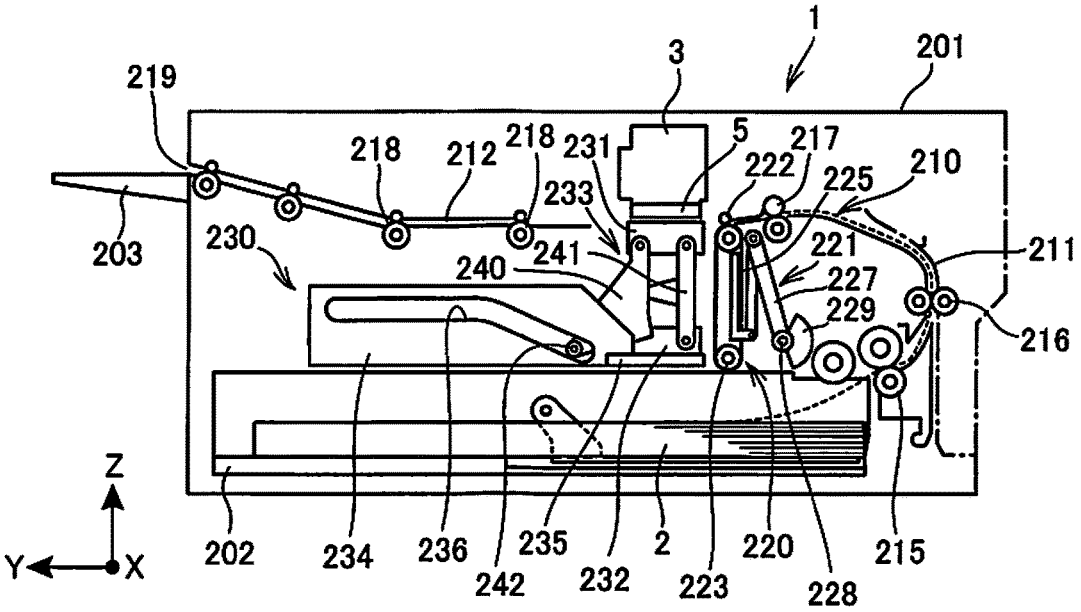
FIG. 8 is a side view illustrating a maintenance state of the printer according to the third embodiment.

FIG. 7 is a side view illustrating a printing state of the printer as the recording apparatus of the present embodiment. FIG. 8 is a side view illustrating a maintenance state of the printer of the present embodiment.

In the present embodiment, the same components as those in each of the embodiments described above are denoted by the same reference numerals and description thereof is omitted.

The printer 1 includes an apparatus main body 201 and the apparatus main body 201 includes a paper storage cassette 202 which stores a plurality of sheets of the recording media 2. The paper storage cassette 202 is detachably attached from the Y direction side in FIG. 7.

In addition, on an upper portion on one side of the apparatus main body 201, there is provided a paper receiving tray 203 which receives the recording medium 2 after recording.

The printer 1 according to the present embodiment includes a paper transport route 210. The paper transport route 210 is configured by a feeding route 211 which transports the recording medium 2 from the paper storage cassette 202 to the printing position and a paper discharge route 212 which transports the recording medium 2 from the printing position to the paper receiving tray 203.

A belt transport means 213 is provided at the printing position between the feeding route 211 and the paper discharge route 212.

In the feeding route 211, there is provided a feeding roller 214, a pair of separation rollers 215, and a pair of transport rollers 216 in order along the transport direction of the recording medium 2. The feeding roller 214 is driven and rotated by a driving motor not illustrated. By nipping the recording medium 2, the pair of the separation rollers 215 separates the recording medium 2. The pair of the transport rollers 216 has a configuration in which one side of the transport rollers 216 is a driving roller which is driven and rotated by the driving motor (not illustrated) and the other side of the transport rollers 216 is a follower roller.

The recording medium 2 stored in the paper storage cassette 202 is fed to a downstream side of the feeding route 211 by the feeding roller 214. The recording medium 2 fed by the feeding roller 214 is nipped by the pair of the separation rollers 215 and the pair of the transport rollers 216 in order and is transported toward the downstream side of the feeding route 211. In addition, on a downstream side of the pair of the transport rollers 216 in the transport direction, a pair of transport rollers 217 are provided.

At a position facing the belt transport means 213, the recording head 3 configured by a line head is disposed.

The recording head 3 includes the nozzle forming unit 5 formed in a line shape. When the recording medium 2 is transported to a region facing the nozzle forming unit 5, the recording head 3 performs recording by the plurality of the nozzles provided in the nozzle forming unit 5 ejecting ink to a recording surface of the recording medium 2.

Although one recording head 3 is illustrated in FIG. 7, actually, the plurality of the recording heads 3 including the plurality of the ejecting nozzles which eject single color ink with different colors are arranged.

By driving the belt, the belt transport means 213 transports the recording medium 2 on the downstream side in the transport direction and supports the recording surface of the recording medium 2 and the other surface of the recording medium 2 at the same time.

The recording medium 2 recorded by the recording head 3 is nipped and transported in order by a pair of transport rollers 218 provided in order along the paper discharge route 212 in the transport direction. Then, the recording medium 2 is discharged from an exit 219 toward the paper receiving tray 203.

The belt transport means 213 provided inside the apparatus main body 201 includes a belt driving unit 220 and a belt swinging unit 221.

The belt driving unit 220 includes a driving shaft 222, a follower shaft 223 disposed at a predetermined distance from the driving shaft 222, a transport belt 224 wrapped around the driving shaft 222 and the follower shaft 223, and a swinging table 225.

Then, by being driven and rotated by the driving motor (not illustrated), the driving shaft 222 can drive the transport belt 224 in the transport direction of the recording medium 2.

In addition, the swinging table 225 is disposed between the driving shaft 222 and the follower shaft 223. The swinging table 225 is positioned between an upper side route and a lower side route of the transport belt 224 in a device height direction. The swinging table 225 is extended in an axial direction of the driving shaft 222 and both end portions of the swinging table 225 rotatably support the driving shaft 222.

As illustrated in FIG. 7, at a position at which the belt transport means 213 faces to the nozzle forming unit 5 of the recording head 3, printing can be performed on the recording medium 2.

In addition, the belt swinging unit 221 includes a first arm 226, a second arm 227, a swinging shaft 228, and a swinging gear 229.

One tip portion of the first arm 226 is attached to the swinging table 225 in a swingable shape. In addition, the other tip portion of the first arm 226 is attached to one tip portion of the second arm 227 in the swingable shape. In addition, the second arm 227 is attached to the swinging shaft 228 so as to rotate together with the swinging shaft 228.

By swing the swinging gear 229 by a swinging driving motor (not illustrated), the second arm 227 is clockwise swung in FIG. 7 and the first arm 226 is counterclockwise swung with respect to the second arm 227 accordingly. According to this, the swinging table 225 is counterclockwise swung around the driving shaft 222 in FIG. 7 and as illustrated in FIG. 8, the belt transport means 213 can be evacuated from the printing state and can move to the maintenance position.

In addition, the printer 1 includes a maintenance means 230. The maintenance means 230 includes a maintenance unit 231, a moving table 232, a parallel link mechanism 233, a guide member 234, and a base member 235.

The base member 235 is extended in a paper width direction and a pair of guide members 234 are positioned so as to face each other at both end portions in the paper width direction.

The moving table 232 is extended in the paper width direction and the parallel link mechanism 233 is attached to both end portions in the paper width direction. By driving a moving table driving motor (not illustrated), the moving table 232 can reciprocate in the paper transport direction via a power transmission mechanism such as a ball screw (not illustrated).

The parallel link mechanism 233 includes a first link 240 and a second link 241. The first link 240 has an approximately triangle shape and a portion corresponding to a first apex of the first link 240 is rotatably connected with the moving table 232. A portion corresponding to a second apex is rotatably connected with the maintenance unit 231. In addition, in a portion corresponding to a third apex, a guide target portion 242 engaging with a guide groove 236 formed in the guide member 234 is provided.

In the second link 241, one tip of the second link 241 is rotatably connected to the moving table 232 and the other tip of the second link 241 is rotatably connected to the maintenance unit 231.

The maintenance unit 231 is connected to the first link 240 and the second link 241. In addition, the maintenance unit 231 includes the ink collection cap (not illustrated) which covers the nozzle forming unit 5 of the recording head 3.

The maintenance unit 231 is configured to be movable between a non-maintenance position at which the maintenance unit 231 is evacuated from a position facing the nozzle forming unit 5 illustrated in FIG. 7 and the maintenance position at which the maintenance unit 231 is mounted on the nozzle forming unit 5 of the recording head 3 illustrated in FIG. 8.

The present embodiment has a configuration in which one portion of the transport route of the recording medium 2 (medium) can be evacuated from the plurality of the recording heads 3 including each of the plurality of the ejecting nozzles which ejects one type of the ink. That is, in the present embodiment, by the transport route of the recording medium 2 evacuating downward the recording head 3, the recording head 3 is evacuated.

Then, in a state in which the belt transport means 213 is evacuated from the recording head 3, the maintenance unit 231 enters and the ink collection cap is mounted on the nozzle forming unit 5 of the recording head 3 to perform the flushing. At this time, in the same manner as the second embodiment, the ink collection cap includes the ink collection mechanism illustrated in FIG. 1.

According to this, the collected ink ejected to the ink collection cap during the flushing is stored in the reuse collection ink tank 17 and the collected ink with a constant quality is maintained by the virgin ink and the diluted solution. In addition, by providing the ink collection cap in the recording head 3 separated from the transport route of the recording medium 2, it is possible to easily collect the ink ejected by using the flushing.

As described above, in the present embodiment, in the same manner as each of the embodiments, by supplying the virgin ink to the reuse collection ink tank 17 and supplying the diluted solution to the reuse collection ink tank 17, the collected ink with a constant quality can be maintained in the reuse collection ink tank 17 all the time. In addition, since ink for each of ink types is collected, by supplying the ink for each of the ink types from the reuse collection ink tank 17 to the recording head 3, the ink for each of the ink types can be reused and waste ink can be significantly reduced.

Fourth Embodiment

Next, a fourth embodiment of the present invention will be described.

The present embodiment describes an example of a case where ink ejected other than the recording medium 2 is collected during not flushing but printing of the recording head 3.

Figure 9:
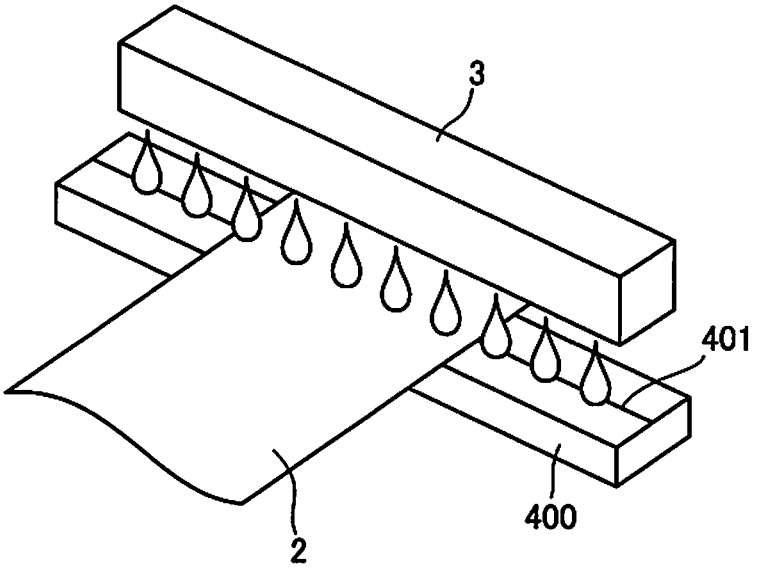
FIG. 9 is a schematic view illustrating a printer according to a fourth embodiment.

FIG. 9 is a schematic view illustrating the fourth embodiment of the printer as the recording apparatus according to the present invention.

In the present embodiment, the same components as those in each of the embodiments described above are denoted by the same reference numerals and description thereof is omitted.

As illustrated in FIG. 9, the printer 1 includes the recording head 3 configured by a line head.

A platen 400 which supports the recording medium 2 is disposed at a position facing to the ejecting nozzle of the recording head 3.

An ink catcher 401 extended in a direction orthogonal to the transport direction of the recording medium 2 and made of thin grooves is provided on a surface facing the recording head 3 of the platen 400.

As illustrated in FIG. 9, in a case where printing is performed on the recording medium 2 shorter than a line length of the recording head 3, there is a case where printing is performed up to an edge of the recording medium 2, for example, borderless printing or the like. Then, ink which does not land on the recording medium 2 is not used for printing. This ink enters the ink catcher 401 and is collected.

A width of the ink catcher 401 of the collected ink is set to a width sufficient and minimum for droplets to be entered. A diameter of the droplet is equal to or smaller than 0.2 mm. Even if a landing position deviates by ±0.1 mm, a gap of the ink catcher 401 can be set to less than 1 mm in consideration of a margin, so that a printing quality is not impaired by bending of a recording paper in a portion of the ink catcher 401.

In addition, the ink catcher 401 includes the ink collection mechanism illustrated in FIG. 1. For example, in the ink collection mechanism, a hole communicated with the ink catcher 401 may be provided and collected ink may be collected from the hole to the reuse collection ink tank via the collected ink outflow pump.

As described above, in the present embodiment, in the same manner as each of the embodiments, by supplying the virgin ink to the reuse collection ink tank and supplying the diluted solution to the reuse collection ink tank, the collected ink with a constant quality can be maintained in the reuse collection ink tank all the time. In addition, since ink for each of ink types is collected, by supplying the ink for each of the ink types from the reuse collection ink tank to the recording head 3, the ink for each of the ink types can be reused and waste ink can be significantly reduced.

In addition, in the present embodiment, the ink collected in the reuse collection ink tank is ink which is ejected during printing operation and does not land on the recording medium 2.

According to this, it is possible to collect the ink which does not land on the recording medium 2 by the ink catcher 401 of the platen 400.

Fifth Embodiment

Next, a fifth embodiment of the present invention will be described.

In the same manner as the fourth embodiment, the present embodiment describes an example of a case where ink ejected other than the recording medium 2 is collected during not flushing but printing of the recording head 3.

Figure 10:
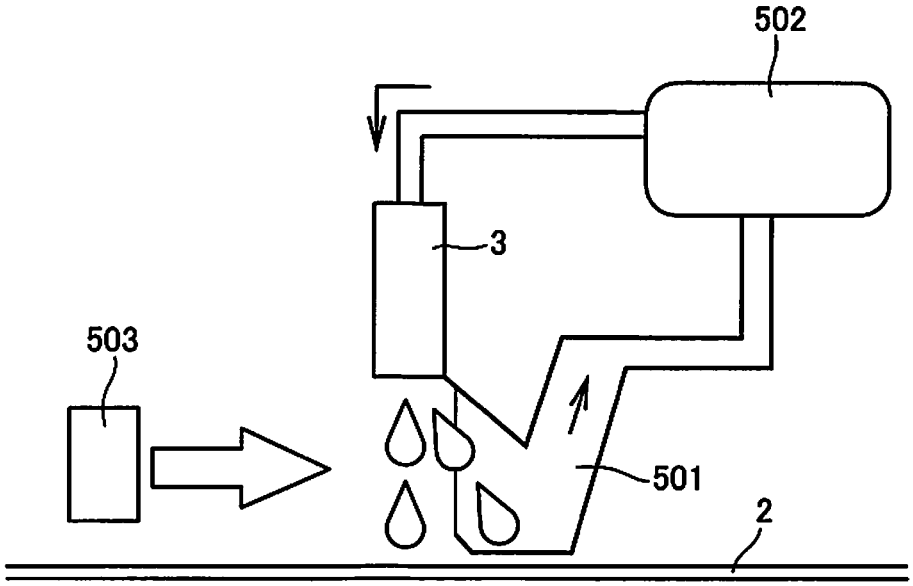
FIG. 10 is a schematic view illustrating a printer according to a fifth embodiment.

FIG. 10 is a schematic view illustrating the fifth embodiment of the printer as the recording apparatus according to the present invention.

In the present embodiment, the same components as those in each of the embodiments described above are denoted by the same reference numerals and description thereof is omitted.

As illustrated in FIG. 10, the printer 1 of the present embodiment includes the recording head 3 which ejects ink on the recording medium 2 to perform printing and is configured by a line head.

An ink catcher 501 opened in the transport direction of the recording medium 2 is provided between the recording head 3 and the recording medium 2. The ink catcher 501 is provided integrally with the recording head 3 and an ink collection mechanism 502 is connected to the ink catcher 501.

In addition, at a position facing to an opening of the ink catcher 501, there is provided an ink collection fan 503 which sends wind for ink collection along the transport direction of the recording medium 2.

A technology of switching between ink droplets to be landed on the recording medium 2 and collected ink droplets is well known under a name of a continuous ink jet method.

As the specific method, (1) a small droplet and a large droplet are made and only the small droplet is blown by an air blast of the ink collection fan 503, so that desired printing is performed. Alternatively, (2) an air blast location by the ink collection fan 503 is changed to a predetermined location, so that the desired printing is performed.

In the present embodiment, when printing is performed while ejecting ink from the recording head 3 to the recording medium 2, the ink collection fan 503 is driven and the air blast is performed toward the ink catcher 501. According to this, the ink which does not land on the recording medium 2 enters the ink catcher 501 by a path of the ink being deflected.

In the same manner as the first embodiment, the ink which enters the ink catcher 501 is collected in the reuse collection ink tank 17 by the ink collection mechanism 502.

In present embodiment, the ink which does not land on the recording medium 2 is collected in the ink catcher 501 using the ink collection fan 503, but the present invention is not limited thereto. For example, the ink may be sucked and collected from an inside of the ink catcher 501, may be electrostatically collected, and may be collected by using a known method.

In addition, as described in the fourth embodiment, on design of the printer 1, the present embodiment is effective in a case where it is difficult to provide the ink catcher 501 configured by thin grooves at a position at which the ink to be printed lands on the recording medium 2.

As described above, in the present embodiment, in the same manner as each of the embodiments, by supplying the virgin ink to the reuse collection ink tank 17 and supplying the diluted solution to the reuse collection ink tank 17, the collected ink with a constant quality can be maintained in the reuse collection ink tank 17 all the time. In addition, since ink for each of ink types is collected, by supplying the ink for each of the ink types from the reuse collection ink tank to the recording head 3, the ink for each of the ink types can be reused and waste ink can be significantly reduced.

In addition, the present embodiment has a configuration in which droplets of the ink collected in the reuse collection ink tank 17 enter the ink catcher 501 provided in the recording head 3 by changing a moving direction of the droplets of the ink which moves during the printing operation.

According to this, it is possible to collect the ink which does not land on the recording medium 2 by the ink catcher 501.

Embodiments described above merely show one embodiment of the invention and can be any modified and applied within the scope of the invention.

For example, in the each of the embodiments, the ink ejected by using the flushing operation of the recording head 3 is collected, but the ink may be collected by other maintenance such as cleaning operation of sucking the ink from the nozzle hole 4.

REFERENCE SIGNS LIST

1 printer; 2 recording medium; 3 recording head; 4 nozzle hole; 5 nozzle forming unit; 6 ink cartridge; 7 ink supply system; 10 capping device; 11 ink collection cap; 12 collected ink discharge hole; 13 collected ink outflow tube; 14 intersection; 15 reuse collection ink outflow tube; 16 waste ink outflow tube; 17 reuse collection ink tank; 18 waste ink tank; 19 reuse side solenoid valve; 20 waste side solenoid valve; 21 collected ink outflow pump; return tube; 23 return pump; 24 diluted solution tank; 25 diluted solution tube; 26 diluted solution pump; 27 virgin ink tank; 28 virgin ink tube; 29 virgin ink supplement pump; 30 viscosity sensor; 31 pressure adjustment flow path; and 32 pressure adjustment valve.

The invention claimed is:

1. A recording apparatus which ejects different types of ink on a medium, the apparatus comprising:

a recording head;

a collected ink storage unit which collects and stores ink ejected from the recording head for each of the types of the ink;

an ink supplement flow path through which virgin ink is supplied to the collected ink storage unit according to an amount of the ink collected from the recording head to the collected ink storage unit;

a diluted solution flow path through which a diluted solution is supplied to the collected ink storage unit according to viscosity of the ink of the collected ink storage unit; and an ink supply flow path through which the ink stored in the collected ink storage unit is supplied to the recording head.

2. The recording apparatus according to claim 1, further comprising:

a viscosity measurement unit which measures the viscosity of the ink stored in the collected ink storage unit, wherein the diluted solution is supplied to the collected ink storage unit according to the viscosity measured by the viscosity measurement unit.

3. The recording apparatus according to claim 1, wherein each of a plurality of the recording heads which ejects one type of ink includes a plurality of ejecting nozzles, the plurality of the recording heads can be separated from a transport route of the medium, and each of the recording heads separated from the transport route includes an ink collection cap which covers the plurality of the ejecting nozzles.

4. The recording apparatus according to claim 1, wherein one portion of a transport route of the medium can be evacuated from the plurality of the recording heads including the plurality of the ejecting nozzles, each of the ejecting nozzles ejecting one type of ink, and the ink collection cap enters the transport route evacuated from the recording head and covers the plurality of the ejecting nozzles.

5. The recording apparatus according to claim 1, wherein the ink collected in the collected ink storage unit is ink which is flushed and ejected during non-printing operation.

6. The recording apparatus according to claim 1, wherein the ink collected in the collected ink storage unit is ink which is ejected and does not land on the medium during printing operation.

7. The recording apparatus according to claim 6, wherein droplets of the ink collected in the collected ink storage unit enter an ink catcher provided in the recording head by changing a moving direction of the droplets of the ink which moves during the printing operation.

8. The recording apparatus according to claim 1, wherein a pressure adjustment mechanism in which a pressure inside the collected ink storage unit is set to a negative pressure is provided.

* * * * *